United States Patent [19]

Ren et al.

[11] Patent Number: 4,500,859

[45] Date of Patent: Feb. 19, 1985

[54] FILTER FOR EXISTING WAVEGUIDE STRUCTURES

[75] Inventors: Chung-Li Ren, Andover; Matthew V. Thompson, Bradford; Han-Chiu Wang, Andover, all of Mass.

[73] Assignee: AT&T Bell Laboratories, Murray Hill, N.J.

[21] Appl. No.: 482,056

[22] Filed: Apr. 5, 1983

[51] Int. Cl.[3] ..... H01P 1/207; H01P 7/10; H01P 1/00

[52] U.S. Cl. ..... 333/208; 333/202; 333/209; 333/231; 333/248

[58] Field of Search ..... 333/202, 206–212, 333/219, 229, 231, 235, 248, 99 R

[56] References Cited

U.S. PATENT DOCUMENTS

| | | | |
|---|---|---|---|
| 3,487,340 | 12/1969 | Curtis et al. | 333/98 R |
| 3,593,221 | 7/1971 | Reed | 333/208 |
| 3,798,578 | 3/1974 | Konishi et al. | 333/229 |
| 4,124,830 | 11/1978 | Ren | 333/209 |
| 4,321,568 | 3/1982 | Joyal et al. | 333/209 |

*Primary Examiner*—Marvin L. Nussbaum
*Attorney, Agent, or Firm*—John Francis Moran

[57] ABSTRACT

An insertion filter is described for existing waveguide without modification. The filter includes a resilient bifurcated dielectric member (11) which conforms to the internal geometry of the waveguide (21). The dielectric member secures the position of a dielectric resonator (15) and a tuning screw (17) and retains their relative positions. A stud (18) is mounted on one of the bifurcations of the dielectric member to compensate electrically for the presence of the member in the waveguide while the dielectric resonator attenuates waveguide energy in a prescribed frequency band.

5 Claims, 2 Drawing Figures

FILTER FOR EXISTING WAVEGUIDE STRUCTURES

BACKGROUND OF THE INVENTION

This invention relates to microwave filters and, in particular, to waveguide filters employing dielectric resonators.

Conventional mounting arrangements for dielectric resonators involve extensive modification of the waveguide. Typically, an aperture or iris is made in the wall of the waveguide into which extends a portion of the dielectric resonator. The bulk of the resonator is shielded by a metallic housing mounted on the exterior side of the waveguide wall. The length of the filter which corresponds to the direction of propagation of the electromagnetic energy in the waveguide can be shortened by using plural filters at common cross-sectional planes of the waveguide to make the filter assembly more compact. Each time an additional dielectric resonator filter is used, however, there is a cost increment in manufacturing the filter since each resonator requires a separate metallic housing and additional modifications must be made in the waveguide.

In a variety of applications, particularly in the case of existing radio systems, it would be extremely desirable to be able to modify the electrical characteristics of the equipment with minimal physical changes in the actual equipment. Due to the precise machining required at microwave frequencies, physical modifications are expensive. Furthermore, the physical design of existing equipment may place severe space constraints on the modifications which are possible. Accordingly, a filter structure which can be inserted within an existing waveguide which is economical and provides suitable electrical characteristics is useful in numerous applications without equipment modification beyond the mere disassembly and reassembly necessary to install the filter for operation. Of course, the latter operations may also be avoided in the case of new equipment.

SUMMARY OF THE INVENTION

Broadly, the invention takes the form of a waveguide filter utilizing dielectric resonators which are physically inserted into an existing waveguide. In addition to the basic filtering function, provision is made for pretuning the filter and electrically compensating for the physical presence of the filter within the waveguide.

An insertion filter is designed for retrofitting into an existing waveguide without modification. The filter includes a resilient bifurcated dielectric body member which conforms to the internal geometry of the waveguide. A dielectric resonator and a tuning screw are retained at preselected mounting positions within the waveguide. The physical shape of the dielectric body member provides a secure friction fit in the waveguide and maintains a predetermined distance between the resonator and a wall of the waveguide. A stud is mounted on one of the bifurcations of the dielectric body member to compensate electrically for the presence of the filter unit in the waveguide. The dielectric resonator is pretuned by adjustment of the screw to attenuate waveguide energy in a prescribed frequency band.

BRIEF DESCRIPTION OF THE DRAWING

The foregoing and other features and advantages of this invention will be more fully understood from the following description of an illustrative embodiment taken in conjunction with the accompanying drawing. In the drawing.

DETAILED DESCRIPTION

Figure 1:
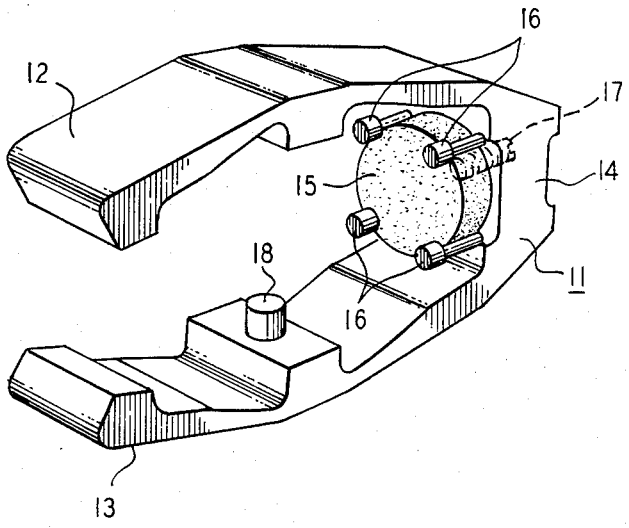
FIG. 1 is a perspective view of the filter assembly.
Figure 2:
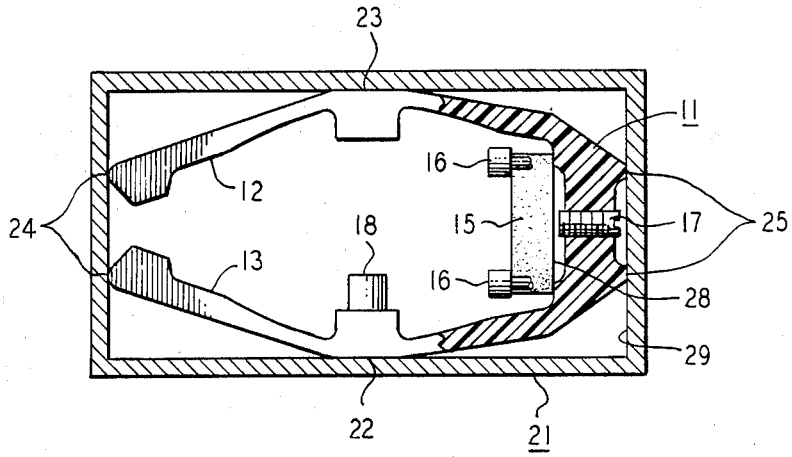
FIG. 2 illustrates the filter assembly in position for operation in a waveguide cavity.

In FIG. 1, body member 11 includes two bifurcated sections 12 and 13 extending from bridging portion 14 which includes a mounting surface for dielectric resonator 15. Preferably, the material of body member 11 should be a low loss, flexible, and resilient material. A styrene-phenylene-oxide molding compound, known commercially as NORYL, is a suitable material particularly since its ability to be molded results in relatively low production costs. Dielectric resonator 15 as is evident from FIG. 2 is cylindrically shaped while the composition of the ceramic barium titanate material is $Ba_2Ti_9O_{20}$. This material exhibits a high dielectric constant ($\epsilon=39$), low loss and good temperature stability. Resonator 15 is held in place on body 11 by hold-down pins 16 which are conveniently glued into appropriately located holes (not shown) in the body. Coaxially positioned with respect to resonator 15 is tuning screw 17, located in a threaded hole in body 11. Metallic stud 18 is mounted on body 11 whose dimensions are determined by experimentation to provide electrical compensation by minimizing the effect of placing the filter assembly in a waveguide. Brass was selected as the material for stud 18.

FIG. 2 shows the position which the filter assembly assumes when placed in waveguide 21. A partial sectional view is taken in FIG. 2 of body member 11 to illustrate in clearer fashion the physical relationship of hold-down pins 16 and tuning screw 17 to resonator 15. In this case, the electromagnetic energy in the waveguide 21 is propagating in a direction orthogonal to the plane of FIG. 2. This mode of propagation is known as the $TE_{10}$ mode.

It should be noted that member 11 undergoes compression to fit within waveguide 21. Accordingly, body 11 rests against waveguide 21 at points 22, 23, 24 and 25 which due to conventional manufacturing techniques for waveguides represent the most precisely defined internal surfaces in waveguide 21.

The frequency and bandwidth of the filter are functions of the distance between surface 28 of resonator 15 and waveguide wall 29 which, in this case, is well controlled by the thickness of the bridging portion of body member 11. For a lower frequency and wide bandwidth, this distance is increased. Conversely, for a high frequency and narrow bandwidth this distance is reduced.

Thus, it can be seen that the physical design of body member 11 provides significant advantages for reproducible geometric and electrical properties of the filter assembly. Additionally, the use of hold-down pins 16 minimizes the amount of material and attendant losses in the vicinity of the critical field region of resonator 15. Resonator 15 operates in the $TE_{01\delta}$ mode. Also the radial flexing of bifurcating branches 12 and 13 serves to provide a latitude of tolerance to slight differences in the interior dimensions of waveguide 21.

Body member 11 is also designed so that all of the deformations are elastic to permit multiple insertions and removal of the filter assembly from a waveguide without physical damage. The symmetrical spring action inherent to the shape of body member 11 provides a self-centering position of the filter assembly within waveguide 21. The spring action further serves to generate friction to provide a self-securing placement within waveguide 21. In the interest of ease of manufacturing the portions of body member 11 which are associated with the bearing surfaces are made bulky to facilitate removal of body member 11 after being formed in its mold.

Another feature of this arrangement is that utilization of tuning screw 17 relaxes the physical tolerances of the dimensions of resonator 15 while enabling accurate fine tuning of the filter. In practice, a section of test waveguide with a small hole to provide access to tuning screw 17 may be used to preset the filter for the desired frequency of operation. Accordingly, the filter is pretuned and ready for insertion into a conventional waveguide.

Various modifications of the illustrative filter described herein may be made without departing from the foregoing inventive principles. For example, it is possible to orient the dielectric resonator differently than that shown and have it couple to the $TE_{10}$ propagation mode of electromagnetic energy. Of course, each mode of propagation and geometry of a cross-section of the waveguide, to a large extent, define possible orientations for positioning the dielectric resonator in the waveguide. The dielectric resonator may be other shapes than the cylindrical shape used in the illustrative embodiment. Also, more than one filter assembly may be employed in a waveguide to provide different filtering responses. Accordingly, it is understood that such modifications are merely illustrative of the numerous and varied other modifications that may be devised by those skilled in the art without departing from the spirit and scope of the invention.

What is claimed is:

1. A device for holding a cylindrical resonator rigidly in a predetermined position within a waveguide comprising a resilient unitary body bifurcated into two portions connected by a bridging portion, the bridging portion bearing against the central region of a first wall of the waveguide and maintaining a predetermined distance between said resonator and the first wall, the bridging portion of the bifurcated body accommodating a metal screw whose axis is colinear with the axis of the cylindrical resonator for tuning its resonant frequency, each of said two portions having a centrally located bearing surface each resting against a central region of one of two opposite walls each intersecting opposite ends of said first wall of the waveguide, and said two portions having end bearing surfaces contacting the central region of the remaining wall of said waveguide opposite said first wall.

2. A device according to claim 1 wherein the cylindrical resonator is a dielectric ceramic material.

3. A device according to claim 2 wherein the dielectric resonator is a barium titanate ($Ba_2Ti_9O_{20}$) ceramic.

4. A device according to claim 2 further comprises a metallic stub mounted on the unitary body to provide compensation for presence of the device in the waveguide.

5. In an existing waveguide having an interior cross-sectional area conforming to a parallelogram for propagating electromagnetic field energy, an insertable and removable filter comprising a unitary body of flexible, resilient material and a cylindrical resonator mounted thereon, the unitary body having two symmetrical bifurcated arms joined together by a bridging portion, each bifurcated arm extending from a first wall to the opposite wall of the existing waveguide with its middle region contacting the mid-portion of one of the walls joining the first and opposite walls, the bridging portion including a planar area a predetermined distance from the first wall of the waveguide to serve as a mounting surface for the resonator, and the unitary body undergoing compression to fit into the interior cross-sectional area of the existing waveguide and exerting sufficient frictional forces on the center regions of the four walls of the existing waveguide to secure the insertable filter at any desired position along the length of the existing waveguide while the cylindrical resonator is positioned at the predetermined distance from the first wall.

* * * * *